US012773020B2

(12) United States Patent
Makowsky et al.

(10) Patent No.: US 12,773,020 B2
(45) Date of Patent: Oct. 27, 2026

(54) ARTICLES WITH EMBEDDED SENSORS

(71) Applicant: LULULEMON ATHLETICA CANADA INC., Vancouver (CA)

(72) Inventors: John Makowsky, Vancouver (CA); William Ly, Vancouver (CA); Chantelle Dawn Murnaghan, Vancouver (CA); Thomas McCarthy Waller, Vancouver (CA); Adrian Ka Ming Lai, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 966 days.

(21) Appl. No.: 18/009,968

(22) PCT Filed: Jun. 18, 2021

(86) PCT No.: PCT/CA2021/050841
§ 371 (c)(1),
(2) Date: Dec. 12, 2022

(87) PCT Pub. No.: WO2021/253137
PCT Pub. Date: Dec. 23, 2021

(65) Prior Publication Data

US 2023/0337755 A1 Oct. 26, 2023

Related U.S. Application Data

(60) Provisional application No. 63/041,444, filed on Jun. 19, 2020.

(51) Int. Cl.
*A41D 13/005* (2006.01)
*A41D 1/00* (2018.01)
(Continued)

(52) U.S. Cl.
CPC ..... *A41D 13/0051* (2013.01); *A41D 1/002* (2013.01); *A41D 13/0053* (2013.01);
(Continued)

(58) Field of Classification Search
None
See application file for complete search history.

(56) References Cited

U.S. PATENT DOCUMENTS

2016/0227848 A1* 8/2016 Majoros ..... B62J 33/00
2022/0031499 A1* 2/2022 Gueritee ..... G01P 15/18

FOREIGN PATENT DOCUMENTS

CN 103564878 A 2/2014
CN 103720074 A 4/2014
(Continued)

OTHER PUBLICATIONS

International Search Report dated Aug. 25, 2021 for International Application No. PCT/CA2021/050841.
(Continued)

*Primary Examiner* — John J Norton

(57) ABSTRACT

An article is provided which includes a flexible body configured to cover part of a user's body, at least one humidity sensor coupled to the flexible body and configured to measure a humidity of the user's skin or an internal microclimate; at least one temperature sensor coupled to the flexible body and configured to measure a temperature of the user's skin or an internal microclimate; at least one microclimate control element coupled to the flexible body; a controller functionally coupled to the at least one humidity sensor and the at least one temperature sensor to receive measured humidity and temperature signals as an input and functionally coupled to the at least one microclimate control element, the controller being preprogrammed to maintain the internal microclimate under a discomfort threshold
(Continued)

value; a user interface functionally coupled to the controller; a power supply; and a switch.

15 Claims, 6 Drawing Sheets

(51) Int. Cl.
*A47G 9/02* (2006.01)
*A47G 9/08* (2006.01)

(52) U.S. Cl.
CPC ..... *A47G 9/0215* (2013.01); *A41D 2400/12* (2013.01); *A41D 2400/14* (2013.01); *A47G 9/08* (2013.01)

(56) References Cited

FOREIGN PATENT DOCUMENTS

| | | | |
|---|---|---|---|
| CN | 104172521 | A | 12/2014 |
| KR | 20130137417 | A | 12/2013 |
| WO | 2017/095025 | A1 | 6/2017 |
| WO | 2017162131 | A1 | 9/2017 |
| WO | 2020/121011 | A1 | 6/2020 |

OTHER PUBLICATIONS

Written Opinion dated Aug. 25, 2021 for International Application No. PCT/CA2021/050841.
Zhang et al, Effects of clothing ventilation openings on thermoregulatory responses during exercise, IJFTR vol. 37(2) [Jun. 2012] 162-171.

* cited by examiner

ARTICLES WITH EMBEDDED SENSORS

TECHNICAL FIELD

The present disclosure relates to articles for covering a portion or all of a user's body, and more specifically, to articles of clothing and coverings with embedded sensors.

BACKGROUND

Articles of clothing, especially outerwear such as jackets, may be insulated to protect a user from the cold. Insulated jackets rely on the user's own body heat the keep the user warm. If the insulation is too thin, the user may be cold. If the insulation is too thick, the user may overheat.

To address these issues, numerous articles of clothing have been previously provided that are adapted to contain electrical heating elements built within the garments to supply heat to a user. Such articles of clothing address the needs of people operating outside or in harsh, cold environments. They typically comprise one or more heating elements, a button for switching the heating elements on and off, a battery in a receptacle such as a pocket, and may have more than one level of heat adjustment that is adjustable by the user. Other articles of clothing utilize temperature sensors located inside and out of the article paired with a learning algorithm and mobile "app" on a device such as a phone, to maintain a preferred temperature inside the article of clothing.

However, there exists a continuing need for articles of clothing that can predict a user's discomfort and modulate the inner microclimate of the article of clothing before the user realizes or notices such discomfort, for example, feeling cold, overheating or wet or too sweaty. Furthermore, such articles of clothing need to be fashionable and comfortable to the user.

SUMMARY

In one aspect, the present disclosure provides an article comprising: a flexible body configured to cover at least part of a user's body, a system of sensors comprising at least one humidity sensor and at least one temperature sensor coupled to the flexible body and configured to measure a humidity and a temperature of a user's skin and/or an internal microclimate, an internal microclimate being a space between the flexible body and the user's skin and/or the flexible body and another flexible body; at least one microclimate control element coupled to the flexible body; a controller functionally coupled to the at least one humidity sensor, the at least one temperature sensor, and the at least one microclimate control element, the controller receiving measured humidity and temperature signals as an input, calculating a skin vapour pressure or an internal microclimate vapour pressure, and determining a discomfort value of the user, the controller being preprogrammed to maintain the discomfort value under a preset discomfort threshold value; a user interface functionally coupled to the controller; a power supply configured to power the at least one microclimate control element, the at least one humidity sensor, the at least one temperature sensor, the controller, and the user interface; and a switch to trigger the power supply, wherein, based on the discomfort value and the preset discomfort threshold value, the controller provides an output signal to maintain or modulate the microclimate control element.

In various embodiments, the at least one humidity sensor and the at least one temperature sensor are integrated into a single component.

In various embodiments, the at least one microclimate control element is coupled to an inner surface of the flexible body.

In various embodiments, the at least one microclimate control element comprises an adjusting system coupled to the flexible body, the controller configured to actuate the adjusting system to move the flexible body closer to or further away from the user's skin.

In various embodiments, the article further comprises a liner positioned between the flexible body and the user's skin, wherein the at least one microclimate control element comprises an adjusting system coupled to the liner, the controller configured to actuate the adjusting system to move the liner closer to or away from the user's skin.

In various embodiments, the article further comprises an air impermeable liner positioned between the flexible body and the user's skin defining a second microclimate space between the air impermeable liner and the flexible body, the flexible body being air impermeable, wherein the at least one microclimate control element comprises an air pump coupled to the second microclimate space to inflate, or deflate the space between the air impermeable flexible body and the air impermeable liner to increase, or decrease the insulating properties of the article.

In various embodiments, the article further comprises an inflatable chamber coupled to an inner surface of the flexible body, the at least one microclimate control element comprising an air pump coupled to the inflatable chamber to inflate, or deflate the inflatable chamber to increase, or decrease the insulating properties of the article.

In various embodiments, the article further comprises a liner positioned between the flexible body and the user's skin defining a second microclimate space between the liner and the flexible body and an inflatable chamber positioned in the second microclimate space, wherein the at least one microclimate control element comprises an air pump coupled to the inflatable chamber to inflate, or deflate the inflatable chamber to increase, or decrease the insulating properties of the article.

In various embodiments, the at least one microclimate control element comprises at least one heating element. For example, the at least one heating element is a resistive heating element. The resistive heating element may be woven or knitted into the article. In a further example, the at least one heating element is a conductive ink. In another example, the at least one heating element is a conductive film. In a further example, the at least one heating element is a conductive yarn or a conductive textile. In a further example, the at least one heating element is a thermoelectric heat pump, such as a Peltier device.

In various embodiments, the at least one microclimate control element comprises at least one cooling element. For example, the at least one cool element may comprise a cooling liquid source and a liquid circulation system. In another example, the at least one cooling element is a thermoelectric cooler, such as a Peltier device.

In various embodiments, the at least one microclimate control element comprises at least one fluid circulating device. For example, the at least one fluid circulating device comprises an electroactive polymer configured to allow fluid circulation within the internal microclimate by changing a shape or size of the electroactive polymer. In another example, the at least one fluid circulating device comprises a fan operationally coupled to the power source.

In various embodiments, the discomfort threshold value is a vapour pressure value between about 1.2 kPa and about 4.2 kPa skin vapour pressure or vapour pressure measured in the internal microclimate, or a relative change of about 0.5 kPa to about 2 kPa in the measured skin vapour pressure or the measured internal microclimate vapour pressure.

In various embodiments, the discomfort threshold value changes depending on the user's activity and environmental conditions.

In various embodiments, the controller automatically modulates the at least one microclimate control element when the discomfort value is above the discomfort threshold value.

In various embodiments, the controller automatically modulates the at least one microclimate control element when the discomfort value shows a change in measured vapour pressure of about 0.5 kPa or more.

In various embodiments, the controller sends an output signal to notify the user, the user manually modulating the microclimate control element using the user interface.

In various embodiments, the article further comprises at least one haptic device functionally coupled to the user interface to provide a feedback signal to the user.

In various embodiments, the article further comprises at least one light source functionally coupled to the user interface to provide a light feedback signal to the user.

In various embodiments, the article further comprises at least one audio device functionally coupled to the user interface to provide a sound feedback signal to the user.

In various embodiments, the power supply comprises two or more separate power supplies.

In various embodiments, the user interface comprises at least one of a touch sensor, a smart device application, a voice recognition module, a gesture sensor, or an IMU. In other embodiments, the user interface comprises a button.

In various embodiments, the controller determines the discomfort threshold value of the user in real time.

In various embodiments, the article is an article of clothing or a body cover. For example, the article may be an article of clothing such as a jacket, pants, a shirt, footwear, headwear or sleepwear. In a further example, the article is a sleeping bag. In another embodiment, the article is bedding, a blanket or a duvet.

Other aspects and features of the present disclosure will become apparent to those of ordinary skill in the art upon review of the following description of specific embodiments of the disclosure.

BRIEF DESCRIPTION OF THE DRAWINGS

In drawings which illustrate various embodiments of the disclosure.

DETAILED DESCRIPTION

Figure 1:
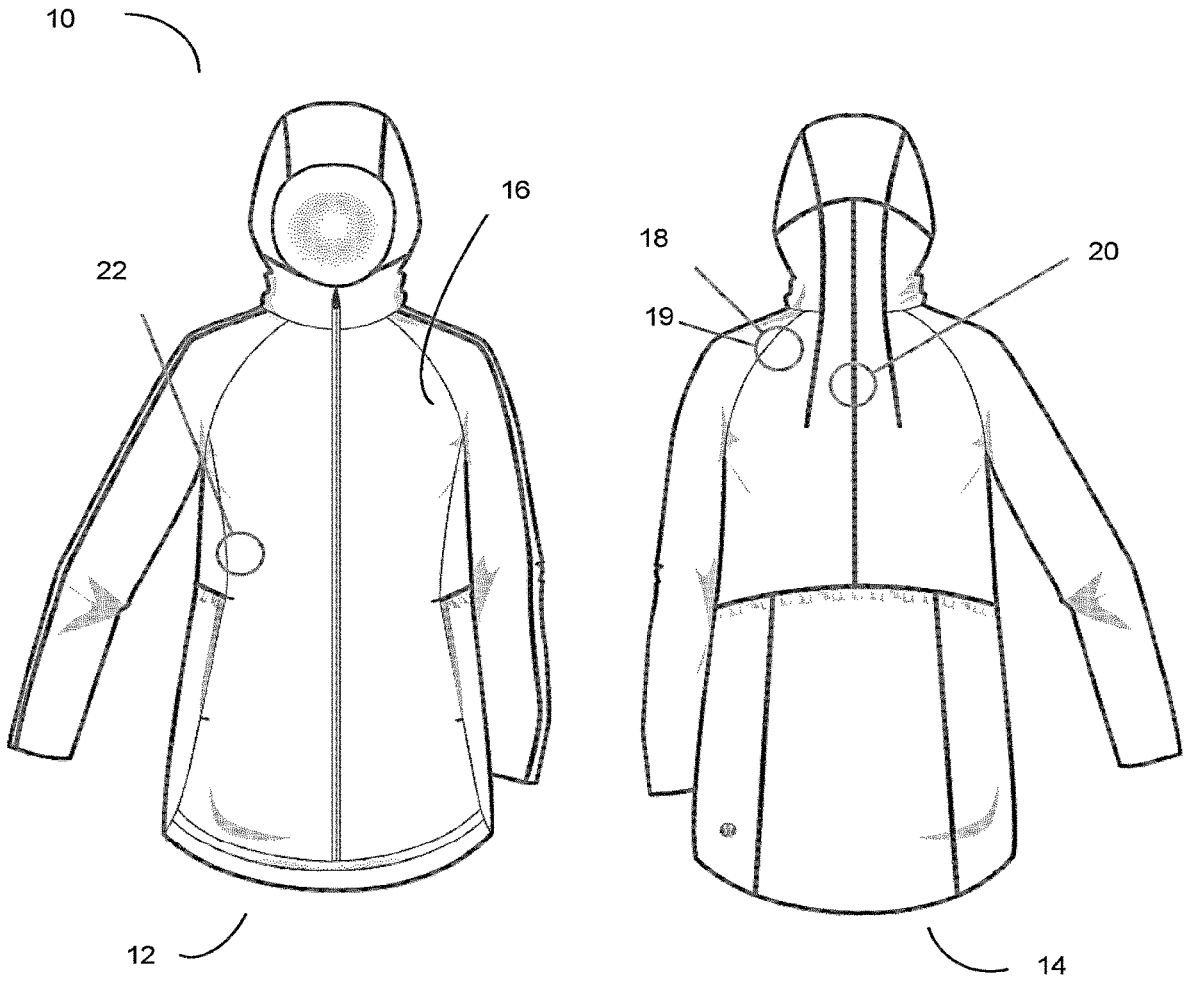
FIG. 1 is a front and back view of an article of clothing in accordance with an embodiment of the disclosure.

In the context of the present disclosure, various terms are used in accordance with what is understood to be the ordinary meaning of those terms.

Disclosed embodiments include articles of clothing or coverings incorporating sensors for measuring environmental conditions inside of the article, referred to herein as an internal microclimate of the article, and comparing these measurements to a discomfort threshold value. The internal microclimate of the article is defined by the moisture or humidity, and temperature in the space between a body of the article and the skin of the user or between the body of the article and another liner positioned in the article. The discomfort threshold value can be a vapour pressure value (also referred to as skin vapour pressure or the microclimate vapour pressure) between about 1.2 kPa and about 4.2 kPa or a change in the vapour pressure, whether an increase or decrease of the vapour pressure of the skin or microclimate, of about 0.5 kPa to about 2 kPa. For example, if the measurements provide a discomfort value of, for example, 1.8 kPa, which is above the discomfort threshold value, at least one microclimate control element is modulated to adjust the microclimate inside the article, thereby increasing or maintaining the comfort of the user. For example, the internal microclimate of the article can be adjusted whether by heating, cooling, increasing air flow, decreasing air flow, or actuating other components embedded within the article. In a further example, if the vapour pressure drops or increases by, for example, 0.8 kPa, even if the measured vapour pressure is under 1.2 kPa, the at least one microclimate control element is modulated to adjust the microclimate inside the article.

Various embodiments include an article, such as an article of clothing or covering, comprising a flexible body configured to cover at least part of a user's body; at least one humidity sensor and at least one temperature sensor coupled to the flexible body and configured to measure an internal humidity and temperature of an internal microclimate or a skin temperature and humidity. For example, the at least one temperature sensor can be in contact with the skin of the user to measure skin temperature or it can be positioned in the space between the flexible body and the user's skin and, in various embodiments, not touch the user's skin. The at least one temperature sensor can also be located between the flexible body and another article layered below, such as a liner, and can measure the temperature in the internal microclimate of the article. Similarly, the at least one humidity sensor can be positioned above and in close proximity to the skin of the user to measure skin humidity, anywhere in the inner space and away from the skin of the user, or anywhere between the article and another article layered below, such as a liner, to measure the internal microclimate humidity. In various embodiments, the system of sensors can measure both the skin temperature and humidity as well as the temperature and humidity of the internal microclimate.

The article further comprises at least one microclimate control element coupled to the flexible body and a controller functionally coupled to the at least one humidity sensor, the at least one temperature sensor and the at least one microclimate control element. The controller receives measured humidity and temperature signals as an input and calculates the skin or internal microclimate vapour pressure to determine a discomfort value of the user in real time or periodically, for example every few seconds or minutes. The controller is preprogrammed to maintain the internal microclimate under a discomfort threshold value such that if the discomfort value of the user is above the discomfort threshold value, or there is a sudden increase or decrease in the vapour pressure value, it provides an output signal to modulate the at least one microclimate control element. The article can also include a user interface that is functionally coupled to the controller, and a power supply that is configured to power the at least one microclimate control element, the at least one humidity sensor, the at least one temperature sensor, the controller, the user interface and any other component of the article that may require a power supply. The user interface can be used by the user to provide input to the controller, to set the settings for the discomfort threshold values during various activities, or to manually trigger the modulation of the at least one microclimate control element. The power supply can be a single power supply functionally coupled to all separate sensors, elements and components requiring power, or can be multiple power supplies coupled to one or more components to provide power to such components. A switch to trigger the power supply is also provided. The controller is in communication with the switch of the power supply to control the triggering of the power supply.

By incorporating the at least one microclimate control element into the article, the need for insulating layers within such an article is reduced. In various embodiments, this may make the article more flexible and have a lighter feel. The at least one microclimate control element may also provide for one or more of, for example, heating, cooling or adjusting air flow, thereby maintaining the user in comfort in either warm or cool environments, during rest or activity, and when transitioning between each.

According to various embodiments, measuring humidity inside the article enables a more robust prediction of the comfort of the user in warm and cool environments compared to predictions based on temperature alone. An important aspect of thermal comfort in various articles, such as articles of clothing and coverings, is the ability to dissipate heat by sweat evapouration. If the amount of water vapour in the air increases, the vapour pressure increases (and vice versa). When the skin is covered by clothing or another type of covering, the latent heat flux created by the evapouration of sweat cannot be efficiently transmitted through the article of clothing or covering and released to the outer environment. As a result, the vapour pressure of the microclimate inside the article increases and heat dissipation is reduced, leading to discomfort for the user. In some embodiments, a relative change in the vapour pressure, either by increasing or decreasing of the vapour pressure, can be perceived as an indicator of increased discomfort for the user and can trigger the modulation of the at least one microclimate control element.

Thus, based on the internal vapour pressure of an internal microclimate of an article, and/or the relative change of vapour pressure in the internal microclimate, a discomfort value for the user of the article can be determined. In response, when the measured discomfort value is determined to be within a discomfort threshold value, at least one microclimate control element can be modulated to provide thermal regulation to the user.

Figure 6:
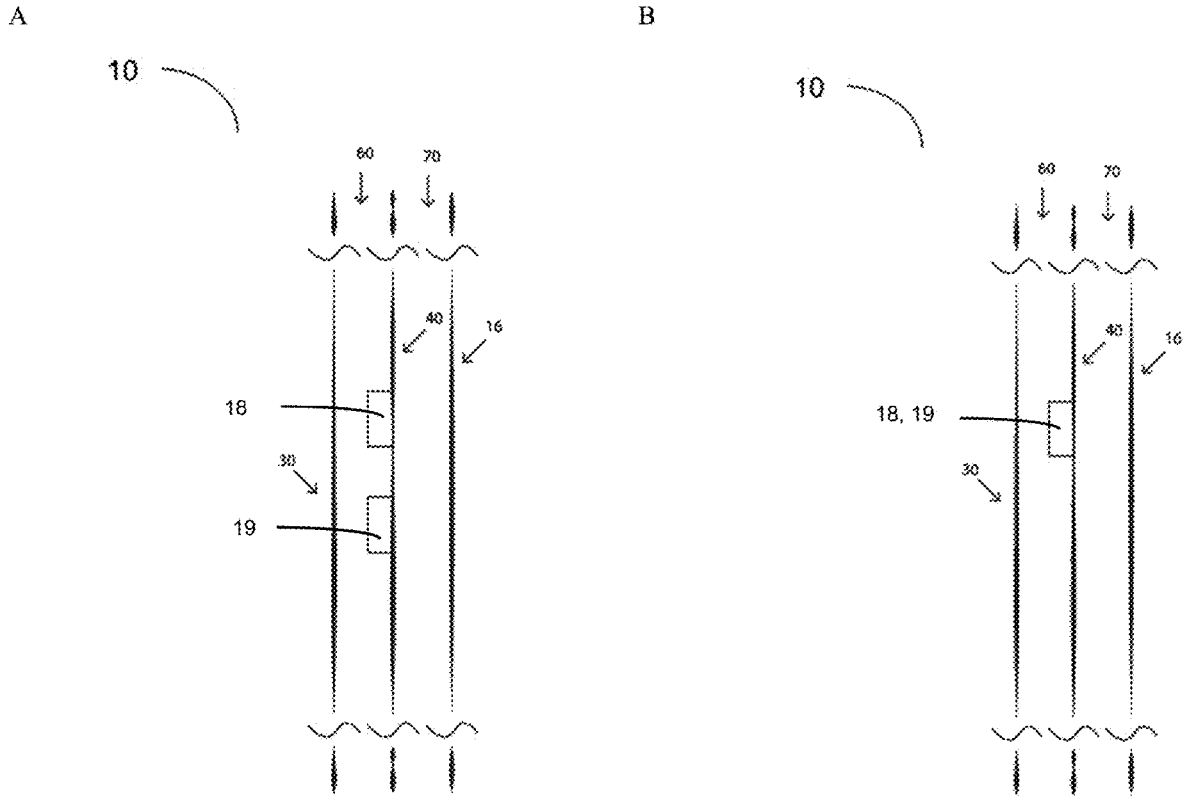
FIG. 6 shows cross-sectional diagram views A and B, each of an article with a lay-up of various components and describing a method for constructing an article in accordance with embodiments of the disclosure.

Referring to FIG. 1 and according to a first embodiment of the disclosure, an article 10 is shown with a front 12 and a back 14. The article 10 in the illustrated example is an article of clothing, such as a jacket. The article 10 comprises a flexible body 16 configured to cover at least part of a user's body. For example, the flexible body 16 can be a fabric of the jacket or any other suitable material such as a foam, a rubber, a polymer, or any other material or combination thereof that is used to make the article 10. In some embodiments, the article of clothing can be pants, shirts, footwear, headwear, sleepwear, or any other apparel. In various embodiments, the article 10 can be a sleeping bag, a blanket, a duvet, or any other suitable cover or covering. The article 10 further comprises at least one humidity sensor 18 (see FIG. 6A), and at least one temperature sensor 19 (FIG. 6A). The at least one humidity sensor 18 and the at least one temperature sensor 19 can be coupled to the flexible body 16, such as to an inner surface of the flexible body 16, or any other liner such as, for example, liner 40 shown in FIG. 6, positioned between the flexible body 16 and the user's body. The at least one internal humidity sensor 18 and the at least one temperature sensor 19 are configured to measure an internal humidity and an internal temperature in the internal microclimate, respectively. In various embodiments, the internal microclimate may be a space between the flexible body 16 and the user's body. The at least one humidity sensor 18 and the at least one temperature sensor 19 may be located at any location on the inner surface of the flexible body 16, preferably without interfering with the comfort and/or movement of the user. The at least one humidity sensor 18 and the at least one temperature sensor 19 can be in proximity to one another or can be spaced apart. In various embodiments, the at least one internal humidity sensor 18 and the at least one temperature sensor 19 may be combined as a single component of the article 10 (FIG. 6B). The at least one temperature sensor 19 can be in contact with the skin of the user to measure a skin temperature of the user or it can be positioned in the internal space between the flexible body 16 and the user's body or any other internal layer, thus measuring the internal microclimate temperature. Similarly, the at least one humidity sensor 18 can be positioned just above or hovering over the skin of the user to measure skin humidity or it can be positioned in the internal space between the flexible body 16 and the user's body or any other internal layer (such as a liner), thus measuring the internal microclimate humidity. In various embodiments, the article 10 can comprise at least one humidity sensor that measures skin humidity, at least one humidity sensor that measures the internal microclimate humidity, at least one temperature sensor that measures skin temperature and at least one temperature sensor that measures the internal microclimate temperature.

Figure 2:
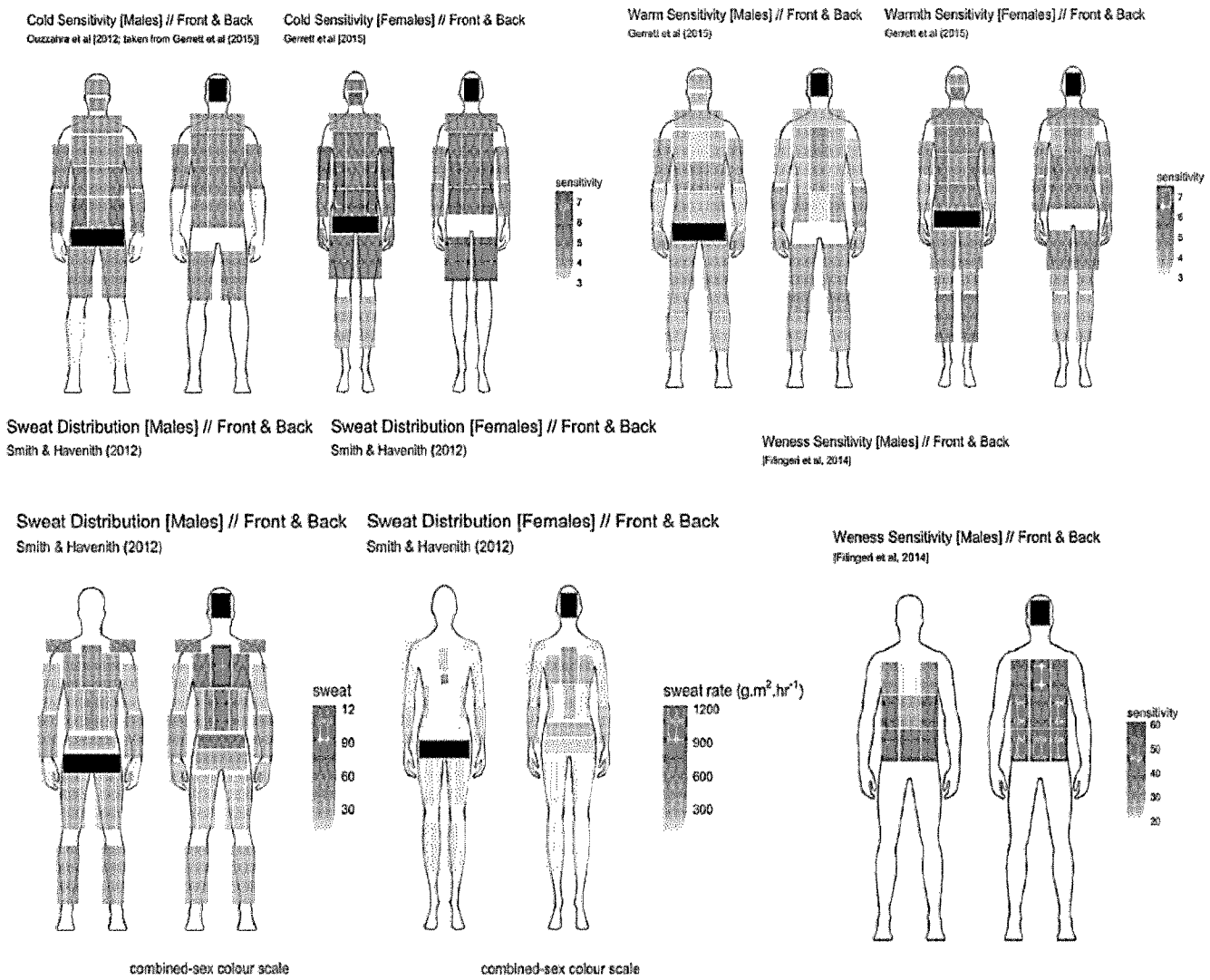
FIG. 2 shows typical male and female, front and back body distributions of cold sensitivity, warmth sensitivity and sweat distribution, and a male front and back body distribution of wetness sensitivity.

In various embodiments, the at least one microclimate control element is coupled to an inner surface of the flexible body 16. In further embodiments, the flexible body 16 comprises multiple layers connected together and forming the flexible body 16. The at least one microclimate control element can be coupled between, or to such layers. An area 20 on the exterior of the flexible body adjacent the at least one microclimate control element is shown in FIG. 1. In various embodiments, the position of the at least one microclimate control element on the flexible body 16 may be determined based on where on the user's body they are most likely to be sensitive to warmth, sensitive to cold, sensitive to wetness from sweat, sweat distribution and accumulation, or any combination thereof. As shown in FIG. 2, there are various locations on the front and back of the user's body where there is increased sensitivity to these factors and thus, positioning the at least one microclimate control element over these areas of increased sensitivity may provide greater comfort to the user. For example, the at least one microclimate control element may be positioned along the sides of a female's article of clothing based on the increased sensitivity to cold and warmth in these areas or positioned on the back of a male's article of clothing as there is higher sweat distribution and warmth sensitivity in this area.

In various embodiments, the at least one microclimate control element comprises at least one heating element and/or at least one cooling element. In various embodiments, the at least one microclimate control element comprises at least one fluid circulating device. In various embodiments, the at least one microclimate control element comprises an adjusting system to bring the flexible body 16 of the article 10 closer to the user's skin. In one embodiment, the article can comprise a liner 40 (see FIG. 6) positioned between the flexible body 16 and the user's body 30. The flexible body 16 can be an outer layer in the multilayered body of the article 10. The liner 40 can cover at least part of the user's body 30 and can be coupled to the adjusting system of the microclimate control element to bring the liner closer to the user's body. For example, the liner 40 can extend as a liner for the entire flexible body 16 of the article 10 (such as the jacket of FIG. 1) or it can cover only parts of the user's body, for example, just the torso. In one embodiment, the liner 40 and the flexible body 16 can form a second microclimate within a second microclimate space 70 between the liner 40 and the flexible body 16 in addition to the internal microclimate space 60 formed between the user's body 30 and the liner 40. The liner 40 can be breathable or air impermeable. In further embodiments, the at least one microclimate control element can comprise an air pump coupled to the second microclimate space 70 and configured to inflate or deflate the second microclimate space 70 of the article 10 to increase or decrease the insulating properties of the article. For example, the liner 40 and the flexile body 16 can be air impermeable in order to allow inflation of the second microclimate space 70. In various embodiments, one or more inflatable chambers can be added in the second microclimate space 70 between the liner 40 and the flexible body 16. In such embodiments, the liner 40 and the flexible body 16 can be breathable and the air pump can be operationally coupled to the one or more inflatable chambers. In one embodiment, the liner 40 can be omitted and the one or more inflatable chambers can be connected to the inner or outer surface of the flexible body 16.

In various embodiments, the at the least one microclimate control element can be at least one fluid circulating device that may comprise an electroactive polymer coupled to the flexible body 16 configured to allow fluid circulation within the internal microclimate by changing a shape or a size of the flexible body structure. For example, a number of slits can be formed in the flexible body 16 and/or the liner 40 so that when the electroactive polymer changes the shape and/or size it can open or close such slits, thus regulating the air flow in the internal microclimate space 60 and the second microclimate space 70. In one embodiment, the at least one fluid circulating device may comprise a fan operationally coupled to a power source.

In various embodiments, the at least one heating element may be a resistive heating element. For example, the resistive heating element may be woven or knitted into the article 10. In other embodiments, the at least one heating element may be a conductive ink, a conductive film, a conductive yarn or a conductive textile. In yet another embodiment, the at least one heating element may be a thermoelectric heat pump such as a Peltier device or a combination of any of the foregoing. The at least one cooling element may comprise a cooling liquid source and a liquid circulation system. The at least one cooling element may be a thermoelectric cooler such as a Peltier device. The at least one cooling element may be a combination of any of the foregoing.

The article 10 also includes a controller functionally coupled to the at least one humidity sensor and the at least one temperature sensor to receive measured humidity and temperature signals of the skin and/or the internal microclimate as an input and functionally coupled to the at least one microclimate control element and the power supply. The controller is preprogrammed to maintain the internal microclimate under a discomfort threshold value. A user interface is also functionally coupled to the controller. Communication between the at least one humidity sensor, the at least one temperature sensor, the at least one microclimate control element and any other component parts of the article 10 may be wired or wireless.

The controller may be any of various processors as will be recognized by those of ordinary skill in the art. As understood by a person of ordinary skill in the art, a "processor" as used herein includes any hardware system, hardware mechanism or hardware component that processes data, signals or other information. A processor can include a system with a central processing unit, multiple processing units, dedicated circuitry for achieving functionality, or other systems.

The controller is configured to receive measured humidity and temperature signals from the at least one humidity sensor and the at least one temperature sensor, and process such signals to calculate vapour pressure, such as skin vapour pressure and/or the vapour pressure in the internal microclimate. The controller can calculate the vapour pressure using the Clausius-Claperyron equation:

$$\frac{de_s}{dT} - \frac{L_c(T)e_s}{R_c T^2}$$

where $e_s$ is saturation vapour pressure, T is measured temperature, $L_v$ is the specific latent heat of evaporation and $R_v$ is the gas constant. For example, the controller can calculate a saturated water vapour pressure $P_{sk,s}$ using the measured temperature signal $T_{sk}$ (such as skin temperature or internal ambient (microclimate) temperature) using the equation:

$$P_{sk,s} - 0.1\exp\left(18.956 - \frac{4{,}030.18}{T_{sk} + 235}\right)(kPa)$$

and then the calculated saturated water vapour pressure $P_{sk,s}$ value is combined with the measured humidity signal $Rh_{sk}$ to calculate the vapour pressure (i.e., skin vapour pressure or internal microclimate vapour pressure) using the equation:

$$P_{sk} - \left(\frac{RH_{sk}}{100}\right) \times P_{sk,s}(kPa)$$

Based on the calculated vapour pressure on the skin or in the internal microclimate, the controller can determine the discomfort value. The above-mentioned equations can be adapted to calculate vapour pressure of any liquid/gas composition other than water. For example, the user's sweat is unlikely to be 100% water, so if one wants to take into consideration the exact composition of the sweat, the equations' variables will be changed accordingly. For example, an additional sensor can be added to measure sweat composition of the user and provide this data to the controller as an input in the calculation of the vapour pressure for such sweat composition.

As used herein, the term "discomfort value" refers to a state or feeling of the user of the article 10 where the vapour pressure in the internal microclimate of the article 10 is characterized as being too high, or causing excessive sweating, amongst other characteristics, or as a relative change (sudden drop or increase) of the vapour pressure. As used herein, the term "discomfort threshold value" refers to a range of combinations of measurements of the internal microclimate that are perceived as uncomfortable to a population of users for a particular article 10 or to a range of relative changes of vapour pressure in the internal microclimate that are perceived as uncomfortable to a population of users for a particular article 10. The controller can generate a discomfort value in real time, or periodically every few seconds or minutes, and can compare the discomfort value to a discomfort threshold value, and if the determined discomfort value is above the discomfort threshold value or the change of vapour pressure is within the threshold range, then the controller can generate an output signal to modulate the at least one microclimate control element to increase or decrease heating, cooling or air flow, or if the discomfort value is under the discomfort threshold value, the controller can maintain the heating, cooling or air flow in the internal microclimate.

The controller may be connected to a memory and a transceiver, and may deliver processed data as output to one or both of the memory and the transceiver. The memory is configured to store information, including both data and instructions. The data generally include humidity data from the at least one humidity sensor, temperature data from the at least one temperature sensor, data from any other sensors and discomfort value data, along with other data that may be ancillary to the basic operation of the controller. The instructions which are stored at the memory generally include firmware and/or software for execution by the controller, such as a program that controls the settings for the at least one humidity sensor, a program that controls the settings for the at least one temperature sensor, a program that controls the settings for any other component parts or sensors, a program that controls the processing of the humidity data from the at least one humidity sensor, a program that controls the processing of the temperature data from the at least one temperature sensor, a program that controls the processing of data from any other component parts or sensors, a program that controls determining the discomfort value, a program that controls determining the discomfort value in real time, a program that controls comparing the discomfort value to the discomfort threshold value, a program that controls generating an output signal for the at least one microclimate control element, a program that controls the transmission and reception of data via the transceiver, as well as any of various other programs that may be associated with the article 10. In various embodiments, two or more of the foregoing may be combined into one program.

The memory may be of any type capable of storing information accessible by the controller, such as ROM, RAM, write-capable, read-only memories, or other computer-readable media. The data may also be formatted in any computer-readable format such as, but not limited to, binary values, ASCII or Unicode.

In various embodiments, the transceiver comprises a RF transmitter and receiver configured to transmit and receive communications signals over a short range using a wireless communications technology, such as Bluetooth®, using any of various communications protocols. Such transceivers are well known to a person of ordinary skill in the art. The transceiver is configured to communicate with the user interface and the at least one microclimate control element when the transceiver is within a given range of the user interface and the at least one microclimate control element, and transmit data to the user interface and the at least one microclimate control element. The user interface and the at least one microclimate control element include software and hardware configured to facilitate communications with the transceiver. The user interface also includes software and hardware configured to facilitate communications to the user. The hardware may include a display screen configured to visually display graphics, text and other data to the user relating to measurements provided by the sensors, the discomfort threshold, or a comparison of the discomfort threshold to the discomfort threshold value. The hardware may also include a microphone and/or speakers to facilitate audio communications with the user and/or verbal entry of commands to the user interface. In various embodiments, the display screen is a touch screen that allows the user to input data or commands into the user interface.

A power supply 22 is configured to provide power to the at least one microclimate control element, the at least one humidity sensor, the at least one temperature sensor, the controller, any other component parts or sensors and the user interface during use. Persons skilled in the art understand that a separate power supply can be provided to each or some of the at least one microclimate control element, the at least one humidity sensor, the at least one temperature sensor, the controller, or any other component parts or sensors without departing from the scope of the invention. Therefore, the power supply 22 can be one, or multiple separate power supplies coupled to power separate components and/or sensors. In the illustrated example of FIG. 1, the power supply 22 can be in a receptacle or knitted or woven into the flexible body 16. In other implementations, the power supply 22 can be embedded in the flexible body 16 or can be applied to the body 16 as a coating. In various embodiments, the power source 22 is a battery such as a rechargeable battery. The article 10 also includes a switch to trigger the power supply. For example, the switch may be a zipper switch such that the power supply triggers to "on" when the user zips up the article 10 and triggers to "off" when the user zips down the article 10.

In various embodiments, the controller and the user interface may be on the same portable or other personal electronic device such as a smartphone, a tablet computer, a smartwatch or any of various other mobile computing devices. As will be recognized by one of ordinary skill in the art, the components of such devices may vary depending on the type of device used. In other embodiments, the controller and the user interface are separate components such as, for example, in a Jacquard® by Google device. In various embodiments, the controller and/or the user interface may include a touch sensor (for example, a touch screen), an inertial measurement unit that can be used as a sensor (for example, a gesture tracking sensor), a voice recognition module, and/or any other suitable sensor, switch or component to provide input and/or output data, instructions, or to switch on/off any of the components. In one embodiment, the user interface can be designed as a button operatively coupled to the article. In further embodiments, the user interface can comprise a software application or "app" for a smart device, such as, for example, a smart phone.

In various embodiments, the memory is configured to store data of the discomfort threshold value. The discomfort threshold value has been determined by using humidity and temperature sensors to monitor vapour pressure between clothing layers of subjects in a range of environments between −7 and 7 degrees Celsius, engaging in both high and low intensity activities. Subjects recorded their comfort ratings during these trials. Based on the data, subjects experienced discomfort between about 1.2 kPa and about 4.2 kPa skin vapour pressure measured in the internal microclimate, or any value therebetween. In one embodiment, the discomfort threshold value may be a relative change in the measured skin vapour pressure or measured vapour pressure in the internal microclimate (increase or decrease of the vapour pressure) of about 0.5 to about 2 kPa. Similar trends were also observed during climate chamber testing. In various implementations, the memory can store a number of different discomfort thresholds. For example, the user can set up one discomfort threshold value (for example, 2.5 kPa) during activity (e.g., running), and a separate discomfort threshold value (for example, 1.5 kPa) for post-activity time (or pre-activity time), such as before the running or post-running time. The user can manually switch between different modules, each with its unique pre-set discomfort threshold value, using the user interface or the controller can automatically switch the modules and therefore activate a pre-programed discomfort threshold value from a menu based on the data received from one or more sensors (e.g., an accelerometer, a heart rate monitor, etc.). In some embodiments, the processor of the controller can learn from the user's past experiences and/or pre-set discomfort threshold values to determine the user's discomfort threshold value for a particular activity. For example, the controller can learn from the past experiences, such as records stored in the memory of what was perceived by such user as discomfort during a particular activity and/or conditions, and determine automatically the user's discomfort threshold values for different activities and/or conditions. The determined user's discomfort threshold values are stored in the memory and used in order to maintain user comfort during number of different activities. The processing unit of the controller can further process any additional inputs from the user to determine if there are changes in the user's perceived discomfort values and adjust the discomfort threshold values accordingly and store such new discomfort threshold values, as well as the activity and/or condition related to such new discomfort threshold value in the memory.

The controller can generate a discomfort value in real time, or periodically every few seconds or minutes based on the measured humidity and temperature signals as described herein above and will compare the discomfort value to the discomfort threshold settings and the relative change in the vapour pressure settings. For example, if the discomfort value determined by the controller is less than the discomfort threshold value (e.g., less than 2.5 kPa during running or less than 1.5. kPa during post-running) then the controller will maintain the internal microclimate. If the determined discomfort value is greater than the discomfort threshold (e.g., more than 2.5 kPa during running or more than 1.5 kPa post running) then the controller can generate an output signal to modulate the at least one microclimate control element to increase the cooling or the air flow in the microclimate. In various embodiments, if there is a sudden drop or spike in the determined vapour pressure such that the change of the vapour pressure in the internal microclimate is about 0.5 kPa (or greater depending on the presettings) from the previous discomfort threshold value, then the controller may generate an output signal to modulate the at least one microclimate control element even if the vapour pressure in the internal microclimate is less than the preset discomfort threshold value.

Figure 3:
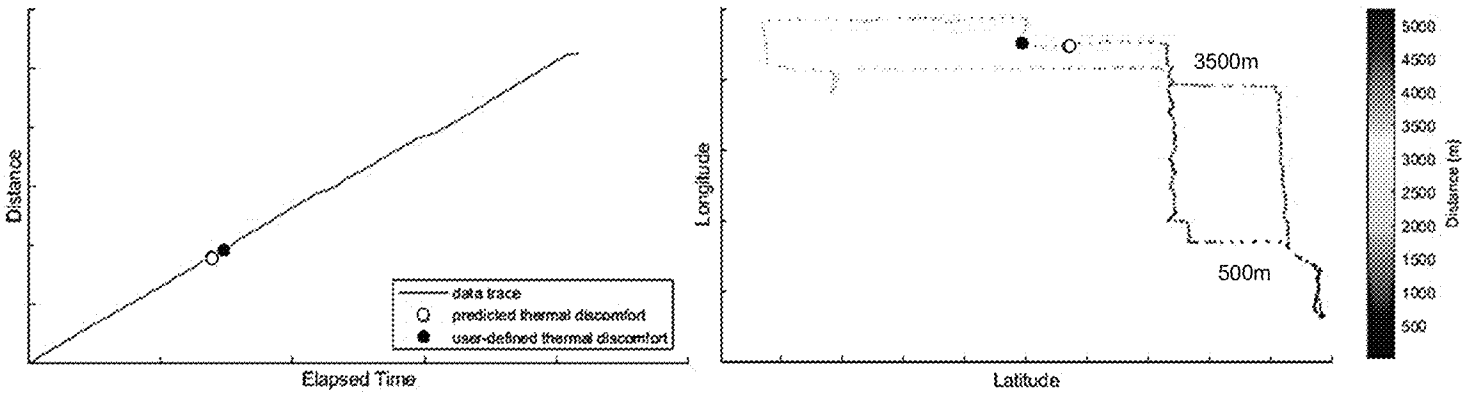
FIG. 3 shows the accuracy of the discomfort threshold value to predict thermal discomfort compared to user-defined perceptual thermal discomfort. Distance, elapsed time and GPS coordinates were taken from a single subject running for 45 minutes at a low-moderate intensity in a temperate external environment.

The accuracy of the discomfort threshold value was tested using a combination of sensors that recorded physiological measurements, such as skin temperature and skin humidity, ambient internal microclimate temperature and ambient internal microclimate humidity, and an algorithm that predicted the perceived whole-body thermal discomfort threshold of the test subject in the given environment and activity. The predicted threshold was compared in time duration with user-defined perceived whole-body thermal discomfort threshold recorded via a time stamping tool available to the subject throughout the duration of the activity. For the test, subjects ran in an ecologically valid external environment for up to one hour while sensors recorded at 5 second intervals. To test the ability of the system to account for variability in test conditions, subject, external environment and activity intensity were varied (n=3 for each condition). The discomfort threshold value achieved a highly accurate prediction of the onset of thermal discomfort compared with user-defined perceptual thermal discomfort as shown in FIG. 3. Specifically, the discomfort threshold value was within 3.27% across the total duration of the trial, which represented a tolerance of within 60 seconds.

The data obtained from the at least one internal humidity sensor and the at least one internal temperature sensor is processed to determine the discomfort value in real time. The discomfort value is then compared to the discomfort threshold value. If the discomfort value is greater than the pre-set discomfort threshold value, an output signal is generated to modulate the at least one microclimate control element by, for example, increasing or decreasing heating, increasing or decreasing cooling or increasing or decreasing air flow. If the discomfort value is below the discomfort threshold value, the at least one microclimate control element may be maintained in its current setting. In this way, discomfort may be predicted based on measurements from the sensors and the at least one microclimate control element may be modulated to intervene with changes to heating, cooling or air flow before the user perceives any discomfort.

In various embodiments, the controller may automatically modulate the at least one microclimate control element. In alternative embodiments, the user may receive the output signal on the user interface in one of various forms such as, for example, a message, a visual cue or a sound, and the user may then modulate the at least one microclimate control element using the user interface. The data may be processed and displayed on the user interface using the software application or "app" stored in a computer readable medium such as the memory of the controller or user interface. The controller is configured to process the instructions for the app. The controller may be controlled by computer-executable instructions stored in memory so as to provide functionality as is described herein.

In various embodiments, portions of the system and methods disclosed herein may be implemented in suitable software code that may reside within the memory. Such software code may be present on the controller at the time of manufacture or may be downloaded thereto via well-known mechanisms. A computer program product implementing an embodiment disclosed herein may therefore comprise one or more computer-readable storage media storing computer instructions translatable by the controller to provide an embodiment of a system or perform an embodiment of a method disclosed herein. Computer instructions may be provided by lines of code in any of various languages as will be recognized by those of ordinary skill in the art. A "computer-readable medium" may be any type of data storage medium that can store computer instructions, including, but not limited to, the memory devices discussed herein.

The article 10 may comprise other component parts such as sensors which are functionally coupled to the controller, the measured signals from such sensors forming part of the input. In various embodiments, the article 10 may further comprise at least one haptic device functionally coupled to the user interface to provide a feedback signal to the user. The article 10 may further comprise at least one light or sound feedback device functionally coupled to the user interface to provide a feedback signal to the user. The article 10 may also comprise a fan operationally coupled to the power source to provide air circulation or air flow within the internal microclimate of the article 10.

Figure 4:
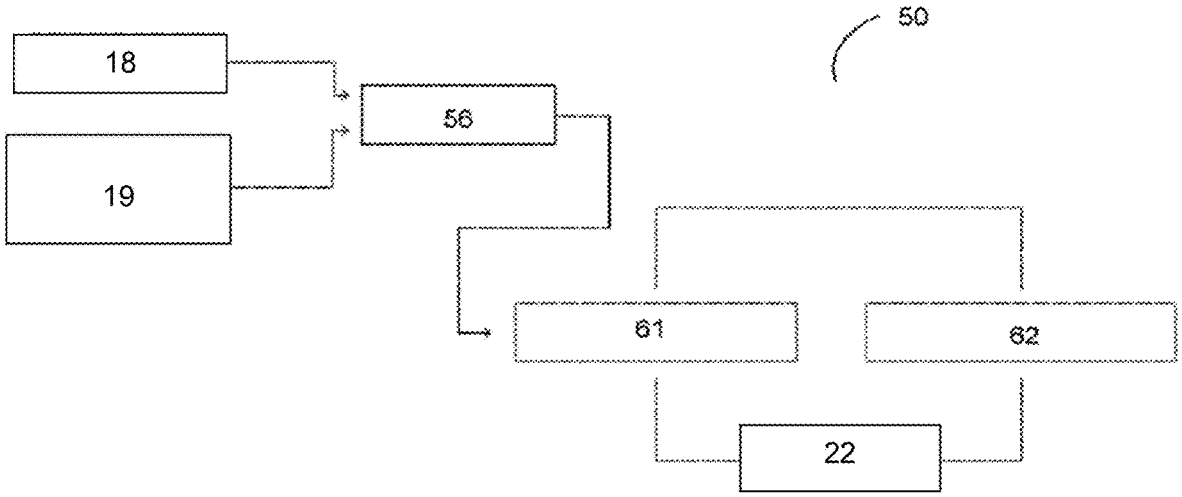
FIG. 4 is a block diagram of a system of modulating the internal humidity microclimate of an article of clothing in accordance with an embodiment of the disclosure.

An exemplary embodiment of a system 50 disclosed herein for modulating an internal microclimate of an article is shown in FIG. 4. The system 50 comprises at least one humidity sensor 18, and at least one temperature sensor 19 and any other external switches, interaction components or sensors, all of which are functionally coupled to the controller 56. As described above, the controller 56 is preprogrammed to maintain the internal vapour pressure within the microclimate of the article of clothing under a discomfort threshold value. The controller is functionally coupled to a power supply 22, such as a battery or other power supply as would be known to a person of ordinary skill in the art, which is triggered by a switch 61, and to at least one microclimate control element 62. The switch 61 may be a relay switch, a transistor switch, a MOSFET switch, or other switch as would be known to a person of ordinary skill in the art. The at least one microclimate control element 62 is for heating or cooling to affect the internal vapour pressure within the microclimate.

Figure 5:
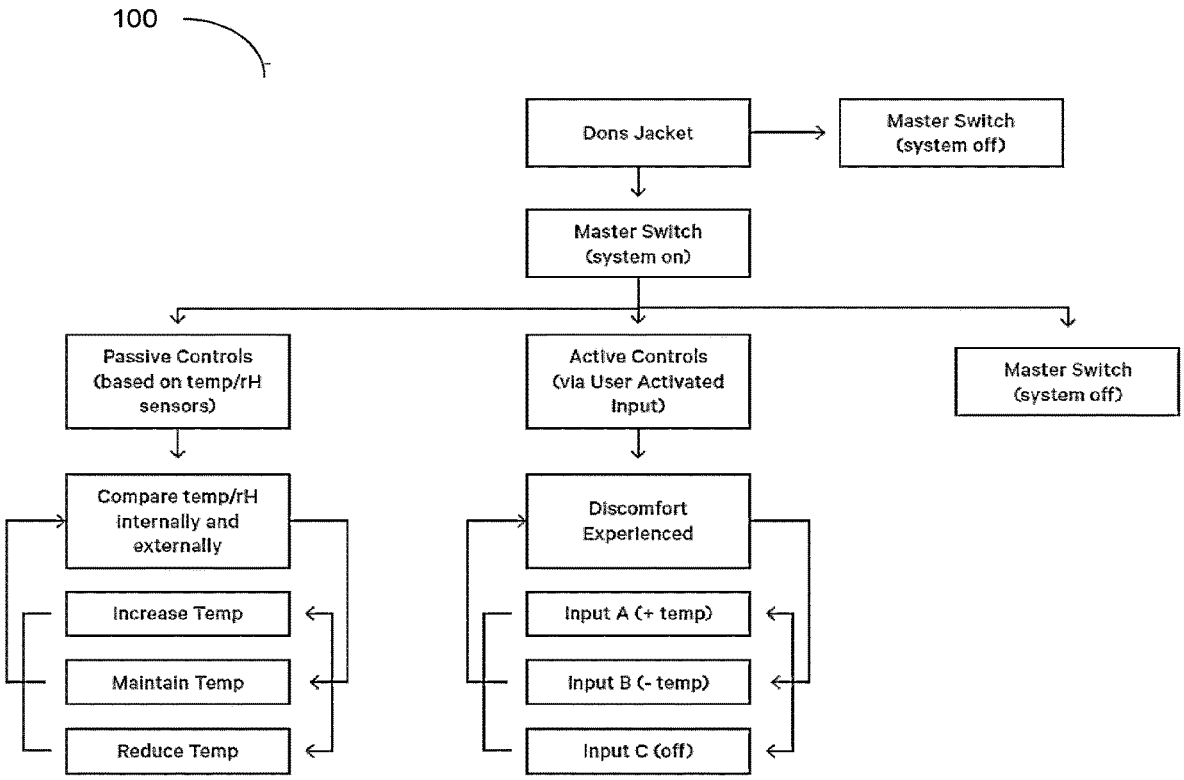
FIG. 5 shows a block diagram of a method of modulating the internal humidity microclimate of an article in accordance with an embodiment of the disclosure.

An exemplary embodiment of the methods disclosed herein is shown in FIG. 5. In various embodiments of a method 100 for modulating an internal vapour pressure within the internal microclimate of an article of clothing, the method includes a user putting on the article of clothing with the switch in the "on" position or the "off" position. If in the "off" position, the user may then use the switch to trigger the power supply into the "on" position. The user may choose passive or automatic control or active control where the user provides an input to the user interface. Under automatic control, the controller compares data from the at least one internal humidity sensor and any other components to generate the discomfort value and compare the discomfort value to the discomfort threshold value. If the discomfort value is greater than the discomfort threshold value, the at least one microclimate control element may modulate the internal vapour pressure within a microclimate by increasing temperature or decreasing temperature, through heating or cooling, respectively. Under active control, when the user receives an output signal from the controller that the discomfort value is above the discomfort threshold value, the user may provide instructions to the user interface to increase temperature, decrease temperature or maintain the current temperature. At any time, the user may use the switch to turn the system "off".

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. Any priority document(s) and all publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

What is claimed is:

1. An article comprising:

a flexible body configured to cover at least part of a user's body;

a system of sensors comprising at least one humidity sensor and at least one temperature sensor coupled to the flexible body and configured to measure a humidity and a temperature of a user's skin and/or an internal microclimate; the internal microclimate being a space between the flexible body and the user's skin and/or the flexible body and another flexible body;

at least one microclimate control element coupled to the flexible body;

a controller functionally coupled to the at least one humidity sensor, the at least one temperature sensor, and the at least one microclimate control element, the controller receiving measured humidity and temperature signals as an input, calculating a skin vapour pressure or an internal microclimate vapour pressure and determining a discomfort value of the user, the controller being preprogrammed to maintain the discomfort value under a preset discomfort threshold value;

a power supply configured to power the at least one microclimate control element, the at least one humidity sensor, the at least one temperature sensor, the controller, and the user interface; and a switch to trigger the power supply, wherein, based on the discomfort value and the preset discomfort threshold value, the controller provides an output signal to maintain or modulate the microclimate control element.

2. The article of claim 1, wherein the at least one humidity sensor and the at least one temperature sensor are integrated.

3. The article of claim 1, wherein the at least one microclimate control element is coupled to an inner surface of the flexible body.

4. The article of claim 1, further comprising a liner positioned between the flexible body and the user's skin.

5. The article of claim 1, further comprising an air impermeable liner positioned between the flexible body and the user's skin defining a second microclimate space between the air impermeable liner and the flexible body, the flexible body being air impermeable.

6. The article of claim 1, further comprising a liner positioned between the flexible body and the user's skin defining a second microclimate space between the liner and the flexible body.

7. The article of claim 1, wherein the at least one microclimate control element comprises at least one heating element.

8. The article claim 1, wherein the at least one microclimate control element comprises at least one cooling element.

9. The article of claim 1, wherein the discomfort threshold value is a vapour pressure value between 1.2 kPa and 4.2 kPa skin vapour pressure or vapour pressure measured in the internal microclimate, or a relative change of 0.5 kPa to 2 kPa in the measured skin vapour pressure or the measured internal microclimate vapour pressure.

10. The article of claim 1, wherein the discomfort threshold value changes depending on the user's activity and environmental conditions.

11. The article of claim 1, wherein the controller automatically modulates the at least one microclimate control element when the discomfort value is above the discomfort threshold value.

12. The article of claim 1, wherein the controller automatically modulates the at least one microclimate control element when the discomfort value shows a change in measured vapour pressure of 0.5 kPa or more.

13. The article of claim 1, wherein the controller sends an output signal to notify the user, the user manually modulating the microclimate control element using the user interface.

14. The article of claim 1, wherein the article is an article of clothing or a body cover.

15. The article of claim 14, wherein the article is a jacket.

* * * * *